US007056022B2

(12) United States Patent
Linton et al.

(10) Patent No.: US 7,056,022 B2
(45) **Date of Patent: *Jun. 6, 2006**

(54) RECLOSABLE BAG HAVING WICKET FLAP AND SLIDER-ACTUATED STRING ZIPPER

(75) Inventors: Basil C. Linton, Loganville, GA (US); Gregory H. Crunkleton, Nicolson, GA (US)

(73) Assignee: Illinois Tool Works Inc., Glenview, IL (US)

( * ) Notice: Subject to any disclaimer, the term of this patent is extended or adjusted under 35 U.S.C. 154(b) by 69 days.

This patent is subject to a terminal disclaimer.

(21) Appl. No.: 10/602,784

(22) Filed: Jun. 24, 2003

(65) Prior Publication Data

US 2004/0161171 A1 Aug. 19, 2004

Related U.S. Application Data

(63) Continuation-in-part of application No. 10/367,450, filed on Feb. 14, 2003, now Pat. No. 6,951,421.

(51) Int. Cl.
*B65D 33/16* (2006.01)

(52) U.S. Cl. ..... 383/64; 383/9; 383/208; 383/209; 383/67; 24/400; 24/427

(58) Field of Classification Search ..... 383/63, 383/64, 203, 204, 207–209, 67, 9; 24/399, 24/400, 427

See application file for complete search history.

(56) References Cited

U.S. PATENT DOCUMENTS

| | | | | |
|---|---|---|---|---|
| 3,808,649 | A | 5/1974 | Ausnit | |
| 4,791,710 | A | 12/1988 | Nocek et al. | |
| 4,923,701 | A | 5/1990 | Van Erden | |
| 4,947,525 | A | 8/1990 | Van Erden | |
| 5,566,429 | A * | 10/1996 | Martinez et al. | 24/585.12 |
| 5,682,730 | A | 11/1997 | Dobreski | |
| 5,794,315 | A * | 8/1998 | Crabtree et al. | 24/589.1 |
| 5,851,071 | A * | 12/1998 | Arnell | 383/63 |
| 5,931,581 | A * | 8/1999 | Garberg et al. | 383/9 |
| 6,138,329 | A * | 10/2000 | Johnson | 24/584.1 |
| 6,213,641 | B1 * | 4/2001 | Price | 383/63 |
| 6,536,951 | B1 * | 3/2003 | Sill | 383/9 |
| 2004/0136618 | A1 * | 7/2004 | Ausnit et al. | 383/64 |
| 2004/0161170 | A1 * | 8/2004 | Linton et al. | 383/64 |

* cited by examiner

*Primary Examiner*—Robin A Hylton
(74) *Attorney, Agent, or Firm*—Ostrager Chong Flaherty & Broitman P.C.

(57) ABSTRACT

A reclosable bag having a bottom flap with holes configured to allow a stack of the bags to be mounted on a wicket, a slider-actuated string zipper installed in a mouth at the top of the bag, and an open string zipper, not actuated by a slider, installed at the bottom of the bag. The wicket flap has a line of weakened tear resistance, such as a perforated line, along which the bag can be torn. Product is inserted into the receptacle via the open string zipper, and then that zipper is closed. After filling, the receptacle can be separated from the flap, which remains on the wicket, by tearing along the tear line.

18 Claims, 6 Drawing Sheets

FIG.5
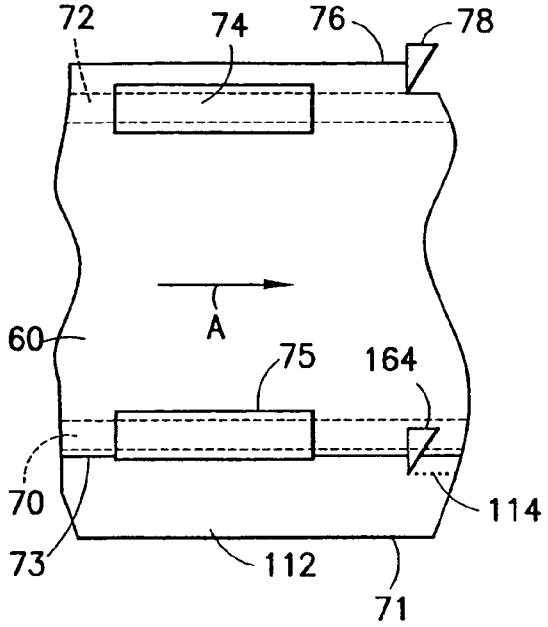
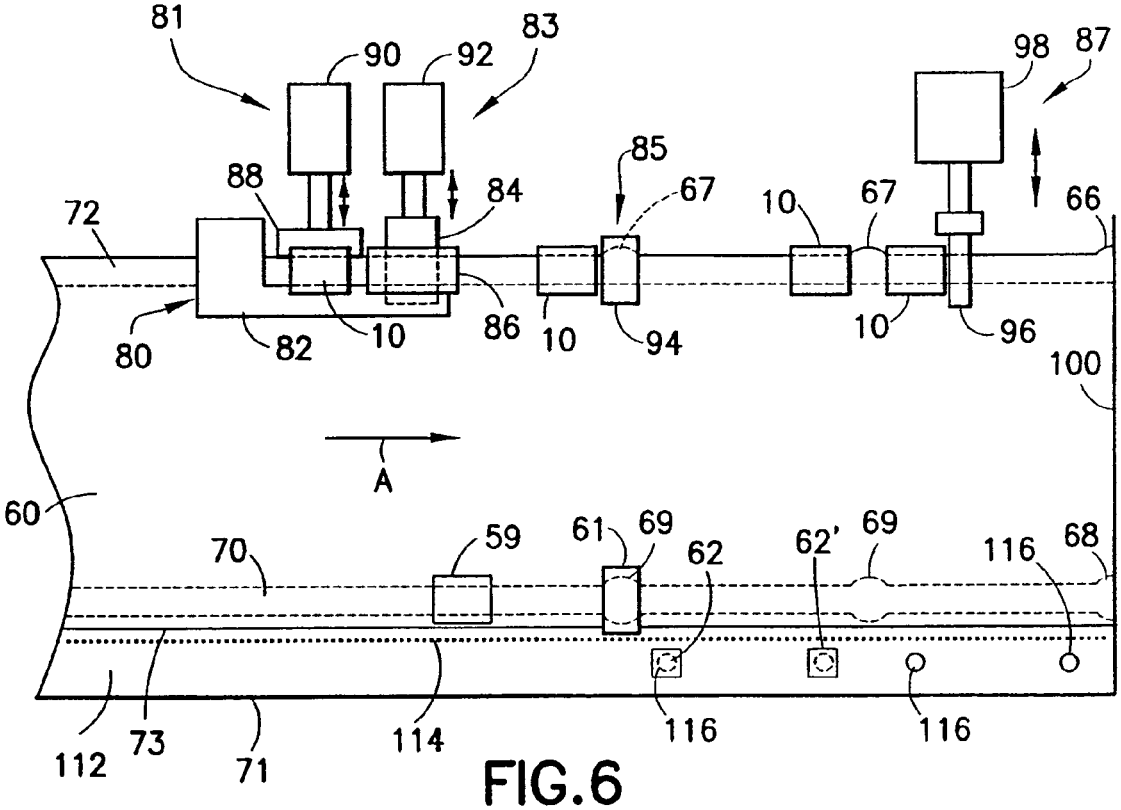
FIG.6

RECLOSABLE BAG HAVING WICKET FLAP AND SLIDER-ACTUATED STRING ZIPPER

RELATED PATENT APPLICATION

This application is a continuation-in-part and claims priority from U.S. patent application Ser. No. 10/367,450 filed on Feb. 14, 2003, now U.S. Pat. No. 6,951,421 and entitled "Reclosable Packaging Having Slider-Operated String Zipper".

BACKGROUND OF THE INVENTION

This invention generally relates to reclosable bags having slider-actuated plastic zippers. In particular, the invention relates to slider-actuated reclosable bags having a header or flap with holes or slits for mounting a stack of bags on a wicket.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a plastic zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Reclosable bags are commonly used by deli clerks in grocery stores to package cheese and deli meats sold to consumers. To facilitate handling of the reclosable bags by the deli clerks, the bags often include a header having one or more holes for mounting a stack of bags to one or more dispensing posts. The reclosable bags are typically mounted to the dispensing posts in bag packs consisting of a predetermined number of bags. The dispensing posts may, e.g., take the form of a U-shaped wicket wherein the legs of the U-shaped wicket penetrate respective holes formed in the header of each bag. The header may take the form of a top header extending upward from the zippered mouth of the bag or a bottom header extending downward from the bottom of the bag.

U.S. Pat. No. 5,682,730 discloses a plurality of plastic bags formed into unitary packs for shipping and loading onto dispensing posts. This is done by stacking the bags and then assembling them into a unitary pack by penetrating the stack with a heated or ultrasonic pin or punch element to form apertures. The bags in the pack are heat-welded or ultrasonically welded together along the periphery of the apertures. To maintain the integrity of the bag pack during shipping, the bag is mounted to dispensing posts in the form of a wicket prior to shipment.

More specifically, U.S. Pat. No. 5,682,730 discloses a reclosable bag having a bottom header with two holes for mounting the plastic bag to a pair of dispensing posts. The holes are spaced apart along a lateral line running generally parallel to the zipper. The bottom header includes a line of perforations that allows the bag to be torn away from the header after the bag has been filled with product. The embodiment illustrated in U.S. Pat. No. 5,682,730 has a bottom header that includes a pair of opposing header panels connected by a fold. The fold forms a primary bottom, while a seal line of thermal fusion forms a secondary bottom at the junction of the receptacle and the header. This patent further states that one of the header panels can be eliminated. The top of the bag U.S. Pat. No. 5,682,730 has a slider-actuated zipper. The zipper comprises two profiled zipper parts that have respective fins or flanges thermally fused to the inner surfaces of the receptacle panels.

An alternative to the aforementioned flanged zipper design is the so-called flangeless or string zipper, which has substantially no flange portions above or below the interlockable zipper strips. In the case of a string zipper, the bag making film is joined to the backs of the bases of the zipper strips. String zippers can be produced at much greater speeds, allow much greater footage to be wound on a spool, thereby requiring less set-up time, and use less material than flanged zippers, enabling a substantial reduction in the cost of manufacture and processing.

U.S. patent application Ser. No. 10/367,450 discloses a reclosable bag in which respective marginal portions of the bag film are sealed to the backs of respective flangeless zipper strips and in which the resulting string zipper is actuated by means of a slider.

There is a continuing need for new designs of wicketed reclosable bags that can be manufactured at low cost.

BRIEF DESCRIPTION OF THE INVENTION

The present invention is directed to a reclosable bag having a bottom flap with holes configured to allow a stack of bags to be mounted on a wicket, a slider-actuated string zipper installed in a mouth at the top of the bag and a string zipper, not actuated by a slider, installed at the bottom of the bag. The invention is further directed to a method of manufacturing such bags. The string zipper at the bottom of the bag is not intended to be opened once it has been closed.

One aspect of the invention is a reclosable bag comprising: a receptacle comprising first and second walls joined at their sides, the first and second walls comprising respective upper marginal portions that form a mouth at a top of the receptacle and respective lower portions at a bottom of the receptacle; a first string zipper comprising a first pair of mutually interlockable zipper parts respectively joined to the upper marginal portions of the first and second walls; a second string zipper comprising a second pair of mutually interlockable zipper parts respectively joined to the lower portions of the first and second walls, the zipper parts of the second pair being interlocked with each other; a slider mounted on the first string zipper for opening and closing the first string zipper; and a flap extending downward from the bottom of the receptacle.

Another aspect of the invention is a method of manufacturing a reclosable bag, comprising the following steps: (a) folding a web of bag making film so that a first portion of the web on one side of the fold has an extension portion that extends beyond an edge of a second portion of the folded web; (b) joining the backs of first and second flangeless zipper strips to one of the first and second web portions before or after the folding step; (c) joining the backs of third and fourth flangeless zipper strips to the other of the first and second web portions before or after the folding step, the first and third zipper strips being mutually confronting to form a first string zipper, and the second and fourth zipper strips being mutually confronting to form a second string zipper that is further away from the folded edge of the web than the first string zipper is; (d) cutting respective portions of the first and second web portions adjacent the first string zipper to remove the folded edge of the web; and (e) inserting a slider on the first string zipper.

A further aspect of the invention is a method of manufacturing a reclosable bag, comprising the following steps: (a) folding a web of bag making film so that a first portion of the web on one side of the fold has an extension portion that extends beyond an edge of a second portion of the folded web; (b) joining the back of a first flangeless zipper strip to the second web portion in a zone proximal to where the fold will or has been formed; (c) joining the back of a second flangeless zipper strip to the first web portion in a zone that will confront the first flangeless zipper strip when the web is in the folded state; (d) joining the back of a third flangeless zipper strip to the second web portion in a zone proximal to the edge of the second web portion; (e) joining the back of a fourth flangeless zipper strip to the first web portion in a zone that will confront the third flangeless zipper strip when the web is in the folded state; (f) cutting respective portions of the first and second web portions adjacent the first and second flangeless zipper strips to remove the folded edge of the web; and (g) inserting a slider on the first and second flangeless zipper strips.

Yet another aspect of the invention is a reclosable bag comprising: a receptacle having a top and a bottom; a first string zipper attached to the top of the receptacle for providing access to an interior volume of the receptacle; a second string zipper attached to the bottom of the receptacle; a slider mounted on the first string zipper for opening and closing the first string zipper; and a flap extending downward from the bottom of the receptacle, the flap comprising a discontinuity and a line of weakened tear resistance that traverses an area disposed between the second string zipper and the discontinuity.

A further aspect of the invention is a method of manufacturing a reclosable bag, comprising the following steps: (a) arranging film material to form opposing walls and a flap connected to one of the walls; (b) joining a first portion of the film material to a back of a first flangeless zipper strip before or after the arranging step; (c) joining a second portion of the film material to a back of a second flangeless zipper strip before or after the arranging step; (d) joining a third portion of the film material to a back of a third flangeless zipper strip before or after the arranging step; (e) joining a fourth portion of the film material to a back of a fourth flangeless zipper strip before or after the arranging step; (f) aligning the first and second flangeless zipper strips with each other; (g) aligning the third and fourth flangeless zipper strips with each other; (h) after steps (b), (c) and (f) have been performed, mounting a slider onto the aligned first and second flangeless zipper strips, with the first portion of the film material being disposed between a first side wall of the slider and a back of the first flangeless zipper strip, and the second portion of the film material being disposed between a second side wall of the slider and a back of the second flangeless zipper strip; and (i) joining fifth and sixth portions of the film material to each other and joining seventh and eighth portions of the film material to each other for forming a receptacle in concert with the first and second opposing walls and the first and second string zippers, the flap being connected to the receptacle.

Other aspects of the invention are disclosed and claimed below.

BRIEF DESCRIPTION OF THE DRAWINGS

FIG. 5 is a drawing showing a top view of a continuous-movement section of an automated production line in accordance with one embodiment of the present invention. The zipper-film assembly is advanced from left to right, as indicated by arrow A.

FIG. 6 is a drawing showing a top view of an intermittent-movement section of the production line, which section follows the continuous-movement section shown in FIG. 5. The continuous movement in the section shown in FIG. 5 is converted to intermittent movement in the section shown in FIG. 6 by a conventional dancer assembly (not shown).

Reference will now be made to the drawings in which similar elements in different drawings bear the same reference numerals.

DETAILED DESCRIPTION OF THE INVENTION

Figure 1:
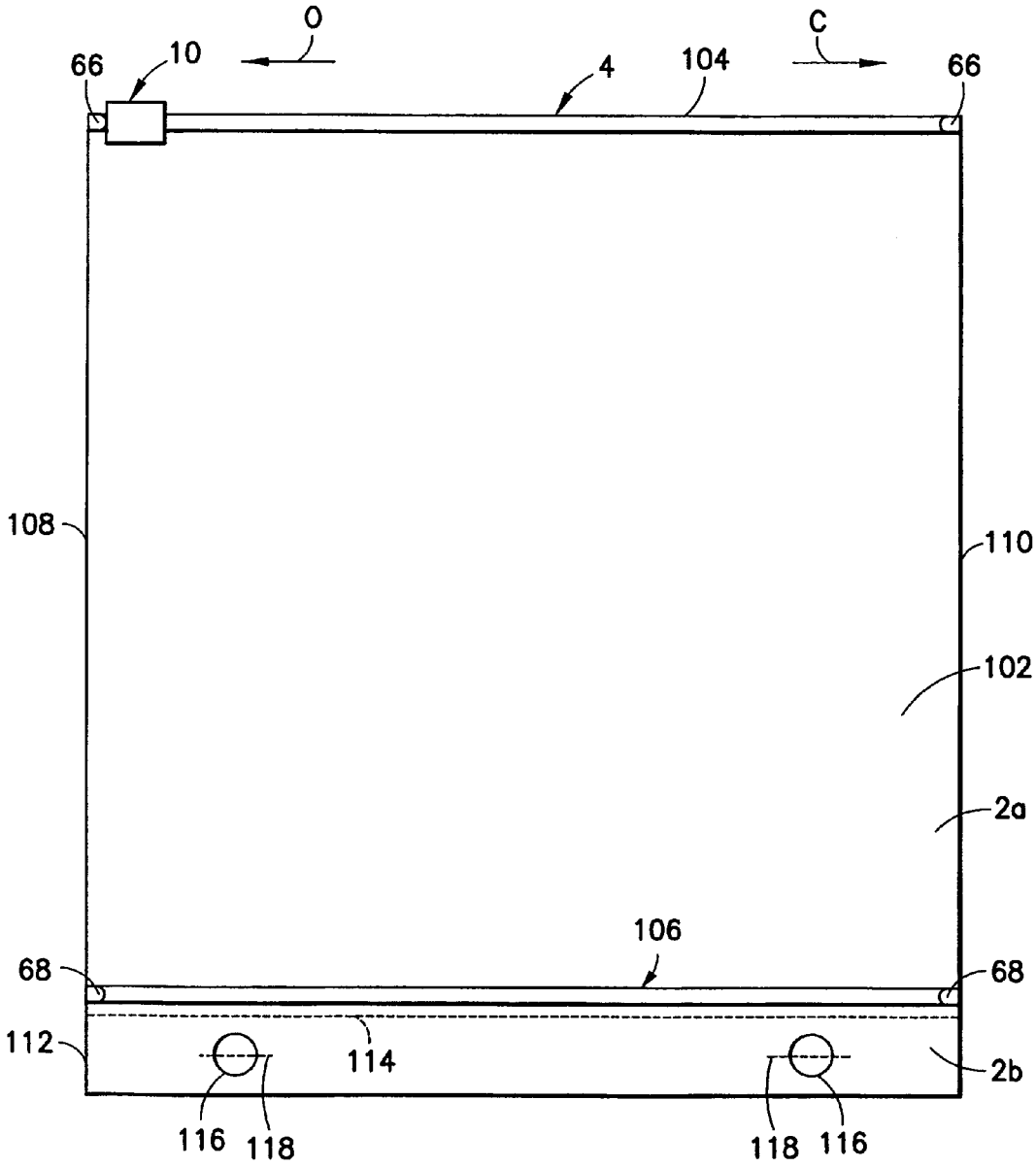
FIG. 1 is a drawing showing a front view of a reclosable bag in accordance with one embodiment of the present invention. For the purpose of this illustration, it has been assumed that the bag film is optically transparent, so that the string zippers are visible behind a layer of film.

A reclosable bag in accordance with one embodiment of the invention is shown in FIG. 1. The bag comprises a receptacle 102 having a top 104, a bottom formed by a string zipper 106, and left and right side seals 108, 110. The string zipper 106 comprises a pair of interlocked zipper strip joined at their ends by respective seals 68. Another string zipper 4 is installed at the top 104 of the bag. String zipper 4 is actuated by a slider 10. The string zipper 4 is opened when the slider 10 is moved in the direction of the arrow O and closed when the slider 10 is moved in the direction of the arrow C. The string zipper 4 comprises a pair of interlocked zipper strip joined at their ends by respective slider end stops 66.

The bag depicted in FIG. 1 further comprises a flap or panel 112 that extends from the bottom of the receptacle 102 in a direction away from the top of the bag. The flap 112 is a rectangle having a length equal to the width of the receptacle 102. The flap has a line 114 of weakened tear resistance that extends along substantially the entire length of the flap 112 in parallel with and spaced apart from the string zipper 106. The line 114 of weakened tear resistance may comprise a line of spaced perforations, a scoreline, or any other functionally equivalent structure. The flap 112 can be integrally formed with either the front or rear wall of the receptacle 102. The flap 112 has a pair of circular holes 116 which are spaced apart along a line running generally parallel to the line 114 of weakened tear resistance. These holes are used to mount each bag on a pair of posts or wicket legs (not shown in FIG. 1) to form a stack. Slits can be used instead of holes. Exemplary slits are indicated by dashed lines 118 in FIG. 1.

Figure 3:
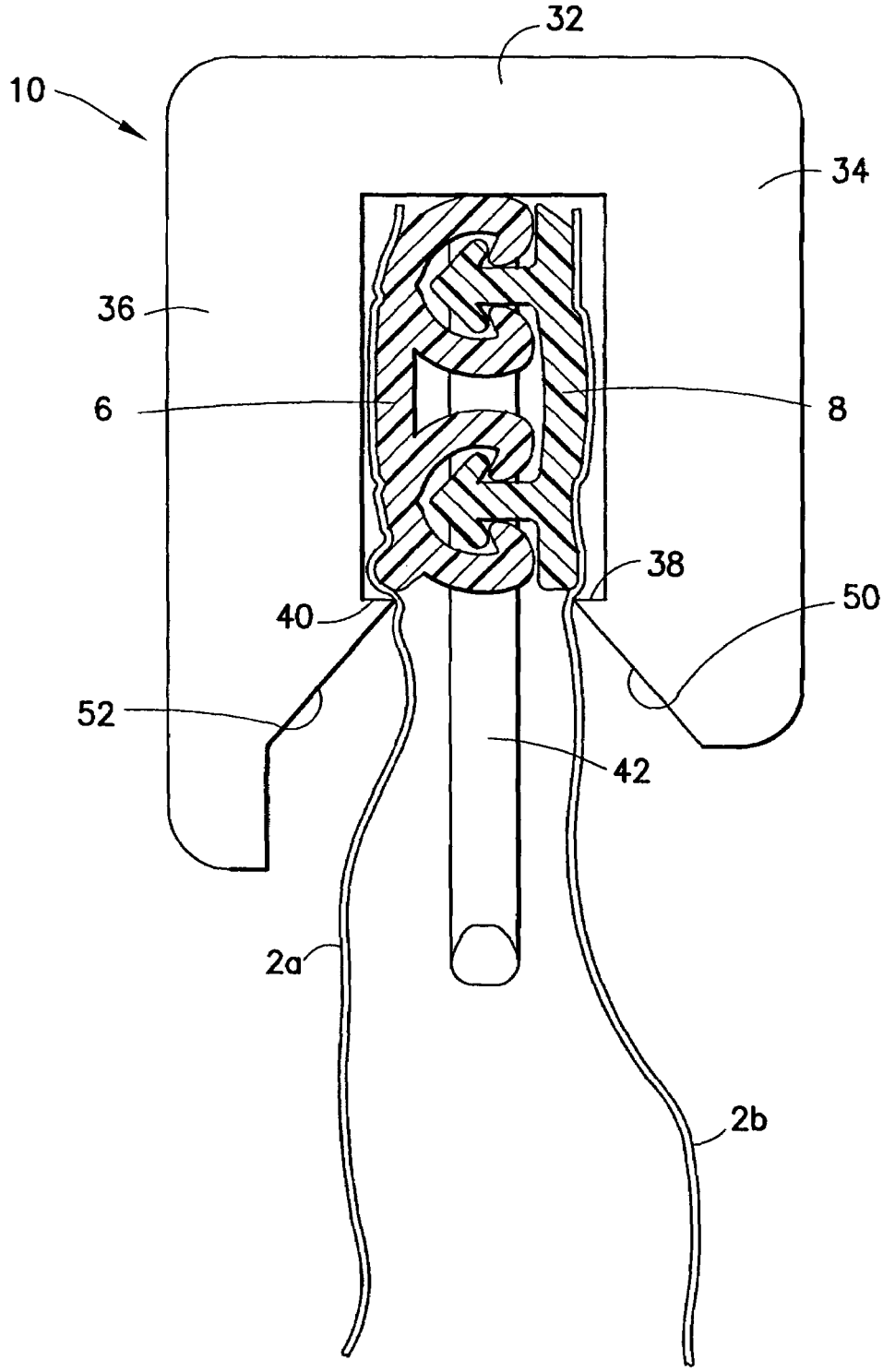
FIG. 3 is a drawing showing a sectional view of a slider-string zipper assembly [previously disclosed in U.S. patent application Ser. No. 10/367,450] incorporated in the bag depicted in FIG. 1. The zipper is shown sectioned in a plane in front of the closing end of the slider.

Bags of the type depicted in FIG. 1 are typically manufactured on a machine. At the end of the production line, when each finished bag comes off the machine, each finished bag is carried and placed over a pair of posts. A predetermined number of bags are placed on the posts to form a stack. The filled posts are then moved and replaced by another set of posts having no bags stacked thereon. The stack of bags is then lifted manually or automatically off of the posts and while the holes are still aligned, the parallel legs of a U-shaped wicket made of wire are passed through the holes. The stack of bags is secured on the wicket and then placed inside a box for shipment, e.g., to a grocery store. In use, the bags are filled with product manually, as depicted in FIG. 3 of U.S. Pat. No. 5,682,730. Then the open top of the bag is closed by manipulation of the slider. Finally, the filled bag is removed from the stack by tearing the bag along the line of weakened tear resistance, thereby severing the filled receptacle from the flap that remains mounted to the wicket.

Alternatively, the bags can be sealed to each other by ultrasonic pins during the process of forming holes for dispensing posts.

Figure 2:
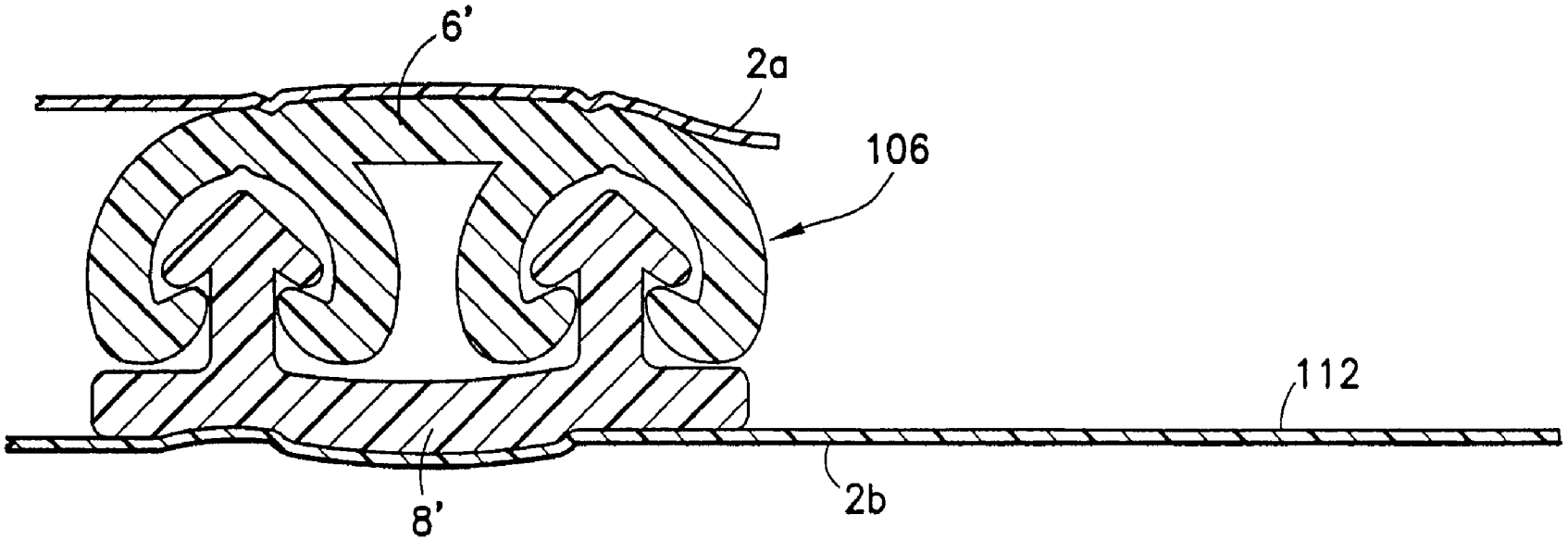
FIG. 2 is a drawing showing a sectional view of a string zipper incorporated in the bottom of the bag shown in FIG. 1.

As seen in FIGS. 2 and 3, the receptacle 102 comprises a front wall 2*a* and a rear wall 2*b*. Referring to FIG. 2, the aforementioned flap 112 is part of the rear wall 2*b* and extends beyond the edge of the front wall 2*a*. The string zipper 106 is sealed, e.g., by conduction heat sealing, to opposing band-shaped zones on the front and rear walls 2*a*, 2*b* of the receptacle. The string zipper 106 extends across the full width of the receptacle and comprises a pair of mutually interlocked, extruded plastic zipper parts or strips 6' and 8'. The zipper strip 6' is placed proximal to the edge of front wall 2*a*.

The string zipper 106 is not intended to be reclosable and thus is designed to not open during normal usage of the reclosable bag. Although string zipper 106 has a construction similar to that of string zipper 4, string zipper 106 has smaller dimensions and is made of low-slip material. In particular, zipper strip 8' comprises a base and two generally arrow-shaped rib-like male closure elements or members projecting from the base, while zipper strip 6' comprises two pairs of hook-shaped gripper jaws connected by a sealing bridge. The male profiles respectively interlock with the female profiles to maintain the closure of string zipper 106. In the disclosed embodiment, the profile of each male member has a stem flanked by shoulders or teeth that converge at the tip of the profile. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile. Each pair of jaws receives and interlocks with a respective male member, as seen in FIG. 2, the hooks effectively latching the heads of the male members. Other zipper constructions could be used that are designed only for interlocking.

The plastic material used in the extrusion of the zipper strips 6' and 8' is selected or treated to provide low-slip surfaces. Because the string zipper 106 is intended to remain closed during usage, no opening mechanism, such as a slider or pull flaps, is provided. The bag making film is attached to the backs of the zipper strips 6' and 8', so that no peeling action is generated by the internal forces exerted when the bag is filled with product. After the bag making film has been joined to the backs of the zipper strips of string zipper 106, the ends of the zipper strips are fused together by the application of ultrasonic wave energy.

Referring to FIG. 3, the bag further comprises a string zipper 4 installed in the mouth at the top of the receptacle and a slider 10 mounted on the string zipper 4 for opening and closing the mouth of the bag. The string zippers 4 and 106 at the top and bottom of the receptacle are generally mutually parallel. The string zipper 4 extends across the full width of the receptacle and comprises a pair of mutually interlocked, extruded plastic zipper parts or strips 6 and 8, the latter, in accordance with one embodiment, being similar in structure to zipper strips 6' and 8' respectively, with several distinctions described hereinafter. However, depending on the closing strength required at the bottom of the bag, the structure of string zipper 4 may be different. The upper marginal portions of the front and rear bag walls 2*a* and 2*b* (see FIG. 3) are respectively sealed to the backs of the zipper strips 6 and 8 by a conventional conduction heat sealing technique. The preferred zipper material is polyethylene or polypropylene.

Figure 4:
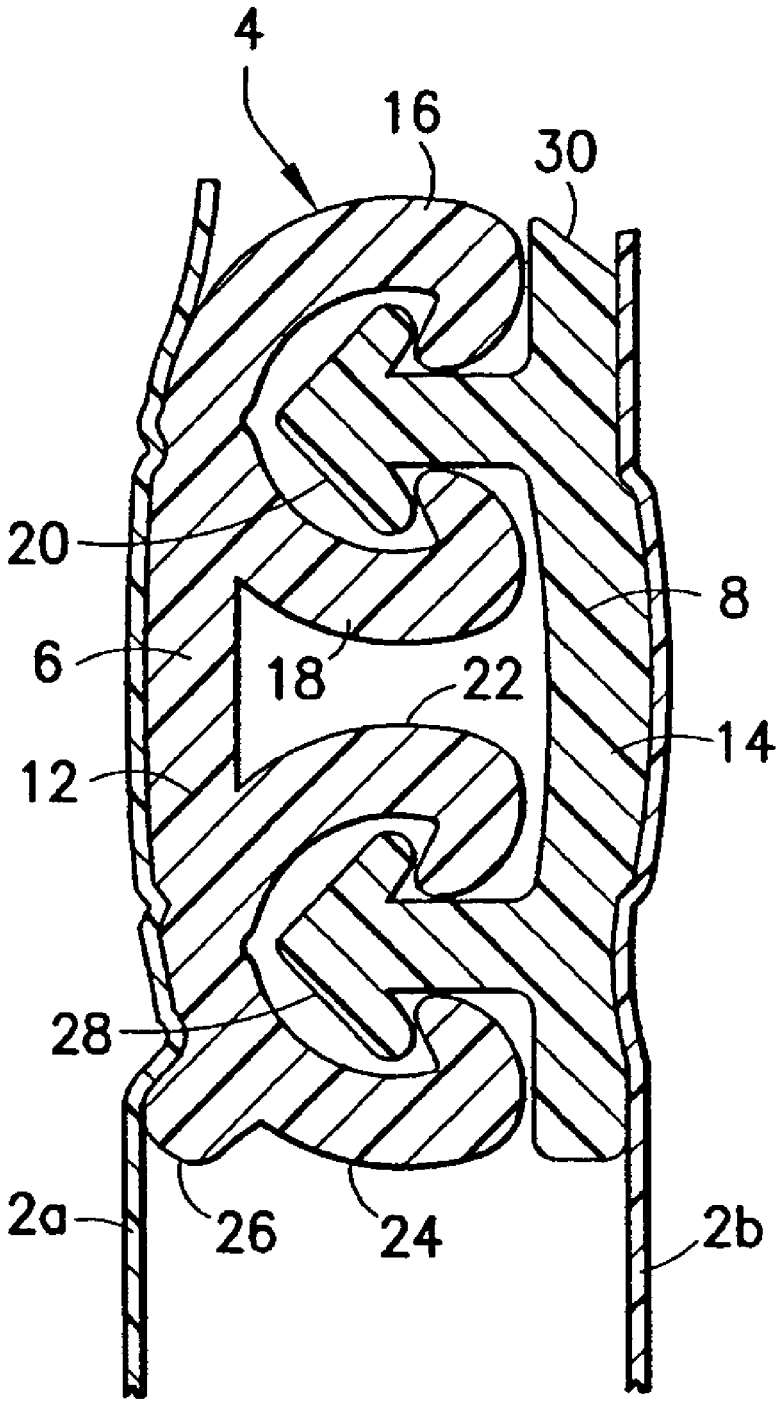
FIG. 4 is a drawing showing, on an enlarged scale, a sectional view of the string zipper incorporated in the assembly of FIG. 3.

The string zipper 4 is shown on a larger scale in FIG. 4. Again the numerals 2*a* and 2*b* indicate the opposing walls (made, e.g., of plastic film) of the receptacle. Zipper strip 8 comprises a base 14 and two generally arrow-shaped rib-like male closure elements or members 20 and 28 projecting from base 14, while zipper strip 6 comprises two pairs of hook-shaped gripper jaws 16, 18 and 22, 24 connected by a sealing bridge 12. The pairs of gripper jaws 16, 18 and 22, 24 form respective complementary female profiles for receiving the male profiles of closure elements 20 and 28.

Still referring to FIG. 4, the sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively. The upper margins of the bag film may have short free ends that extend beyond the termination points depicted in FIG. 4, provided that the free ends are not so long as to interfere with travel of the slider along the zipper or become entangled with the zipper profiles.

The end face of upper edge 30 of the base 14 that carries the male closure elements 20 and 28 is inclined at about a 45° angle to facilitate loading of the slider onto the zipper from above without snagging on a corner of the upper edge. The bottom edge of the base 14 cooperates with a retaining ledge on the slider (to be described later) to increase the slider pull-off resistance. For the same purpose, a rib 26 is formed on zipper part 6, the rib 26 cooperating with a retaining ledge on the other side of the slider.

To open the closed zipper, the zipper parts 6 and 8 are pushed apart with sufficient force by the slider plow (item 42 in FIG. 3) to pry the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile. In addition, although FIGS. 2 and 4 show rib and groove arrangements, the profiles of the zipper strips may take any form. For example, either string zipper may comprise alternating hook-shaped closure elements.

Nor is the invention limited to having two female profiles on one zipper strip and two male profiles on the other zipper strip. In the first place, the string zipper could have one complementary set of male and female profiles, or it could have more than two complementary sets of male and female profiles. Furthermore, in the case of two complementary sets of male and female profiles, one zipper part could have one male profile and one female profile, while the other zipper part has one female profile and one male profile. Other variations should be apparent to persons skilled in the art of reclosable packaging.

Referring again to FIG. 1, the string zipper 4 further comprises end stops 66 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S patent application Ser. No. 10/113,489, entitled "Method and Apparatus for Ultrasonically Stomping Slider End Stops on Zipper". The horn and anvil of the ultrasonic welding apparatus disclosed therein are specifically designed so that the ultrasonic stomping operation create a vertical hump on the zipper to stop the slider, while at the same time preserving the base of the zipper profile to resist pull-off of the slider. Sufficient heat penetrates into the mass of the zipper profile in the end stop areas to fuse the zipper parts together, posing an obstacle to the slider plow. Also, a V-shaped notch can be formed in one end or both ends of the slider top wall for receiving the vertical hump of respective formed end stops. This allows the plow to abut against the fused end of the zipper in the zipper fully closed state.

In the slider-zipper assembly shown in FIG. 3, the slider 10 for opening or closing the reclosable zipper is generally shaped so that the slider straddles the zipper profiles. The upper margins of the bag walls 2*a* and 2*b*, which are joined to the backs of the zipper strips 6 and 8, are disposed between the respective zipper strips and the respective side walls of the slider.

The slider 10 shown in FIG. 3 is more fully disclosed in U.S. patent application Ser. No. 10/367,450. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by a pair of substantially planar, inclined interior surfaces (not visible in FIG. 3), which converge toward the closing window of the slider. The inclined surfaces funnel or squeeze the zipper strips toward each other, causing the zipper profiles to interlock, as the slider is moved in the closing direction.

The slider 10 also comprises a plow or divider 42 that depends downward from a central portion of the top wall 32 to an elevation below the lowermost portions of each side wall. The plow partitions the tunnel inside the slider and is disposed between opposing sections of the zipper strips that pass through the tunnel. The tip of the plow 42 is truncated and has rounded edges and flattened corners at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper strips 6 and 8 apart. The plow 42 divides the opening end of the slider tunnel into respective passages for the separated zipper strips to pass through.

As partly seen in FIG. 3, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance. For improved gripping, the upper surfaces of the retaining ledges may be angled upward toward the distal edge.

The ledges 38 and 40 further comprise respective inclined bottom surfaces 50 and 52 that extend downward and outward from the respective inner edges of the generally horizontal surfaces. The inclined surfaces 50 and 52 are each substantially planar, with the respective planes of these inclined surfaces intersecting at a line inside the tunnel that is generally parallel to the longitudinal axis of the slider. The inclined surfaces 50 and 52 serve to guide the respective zipper strips 6 and 8 into the slider tunnel during insertion of the slider onto the zipper. The sliders are typically inserted at spaced intervals onto a zipper-film assembly that is being intermittently advanced in a machine direction by automated slider insertion equipment.

The generally horizontal surfaces of the retaining ledges latch under the zipper profiles and assist in retaining the slider on the zipper, while the inclined bottom surfaces of the retaining ledges assist in slider insertion onto the zipper by guiding or funneling the respective zipper parts into the slider passageway, including the passages on opposing sides of the plow.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS. To reduce the cost of manufacture, the slider may be designed to reduce the amount of material used and to increase the speed with which such sliders can be injection molded. Suitable injection-molded slider designs are fully disclosed in U.S. patent application Ser. No. 10/412,438.

Reclosable packages of the type depicted in FIG. 1 can be manufactured on an automatic production line. An exemplary production line is shown in FIGS. 5 and 6. FIG. 5 shows a section of the production line in which the zipper strips and bag making film move continuously. FIG. 6 shows a further section in which the zipper strips and bag making film move intermittently. The continuous movement in the section shown in FIG. 5 is converted to intermittent movement in the section shown in FIG. 5 by a conventional dancer assembly (not shown).

The operations performed continuously during continuous advancement include: folding a web of film so that one side of the web extends beyond the edge of other (short) side of the web, the extending portion being hereinafter referred to as the "flap"; introducing one string zipper at an angle and sealing it to the two sides of the web a short distance from the fold; introducing another string zipper at an angle and sealing it to the two sides of the folded web proximal to the edge of the short side of the folded web; trimming the folded edge of film at a point proximal to the nearest string zipper; and forming a line of perforations in the flap (i.e., the extended portion of the long side of the folded web) at a point beyond the edge of the short side of the folded web.

The operations performed intermittently during dwell times include: inserting sliders on the string zipper adjacent to which the folded edge of the film was trimmed; forming slider end stops at spaced intervals on that same string zipper; presealing the other string zipper at spaced intervals; forming pairs of holes in the flap at spaced intervals; and cutting the zipper-film assembly with a hot knife that both seals and severs to form separate packages. Other operations are performed during intermittent advancement of the zipper-film assembly. For example, during each intermittent advancement, the zipper is pried open by a stationary separator assembly at a point upstream of the slider insertion zone. In addition, downstream of the slider insertion zone, a previously inserted slider is held stationary while the zipper-film assembly moves relative thereto, such relative movement of the slider closing a corresponding section of the upper string zipper. The transition from continuous advancement of the film to intermittent advancement of the film is accomplished by a conventional dancer assembly. The foregoing operations will now be described in more detail with reference to FIGS. 5 and 6.

FIG. 5 shows a portion of a web 60 of bag making film after the web has been unwound from a roll (not shown) and then passed over a folding board or plow (not shown) in conventional fashion. The film web is pulled through the by conventional guide and drive rollers (not shown). In FIG. 5, the numeral 76 designates the fold in the web of film. Although the fold is along a line generally parallel to the edges of the web, the fold line is closer to one edge 73 than to the other edge 71. Because the fold is located off-center in the web, one side of the folded web 60 is longer than the other. The shorter side of the folded web is designated 2*a* in FIG. 2; the longer side is designated 2*b* and will ultimately form the wicket flap (item 112 in FIG. 1). The web of film 60 advances continuously in the direction indicated by arrow A.

At the same time, a pair of closed string zippers 70 and 72, each comprising a respective pair of mutually interlocked flangeless zipper strips, are unwound from a respective reel (not shown), fed continuously at an angle and guided into respective positions between the opposing sides of the folded web 60. The zipper 72 is placed proximal to the fold 76, while the zipper 70 is placed adjacent the edge 73 of the web. At a zipper sealing station, opposing portions of the web are joined to the backs of the mutually interlocked zipper strips of string zipper 70 by a pair of mutually opposing conventional heated sealing bars 75 (only one of which is visible in FIG. 5), while opposing portions of the web are joined to the backs of the mutually interlocked zipper strips of string zipper 72 by a pair of mutually opposing conventional heated sealing bars 74 (only one of which is visible in FIG. 5).

The zipper sealing station is conventional apparatus. As the folded web 60 with closed string zipper 72 advances continuously between the opposing sets of sealing bars 74, the respective zipper strips have their backs sealed to the opposing portions of the bag making film, thereby continuously attaching incoming sections of the moving string zipper to adjoining sections of the moving web. The sealing is accomplished by electrically heating the sealing bars 74, the heat being conducted through respective endless barrier strips (not shown) made of Teflon or similar material, which circulate on respective sets of rollers (not shown). Each Teflon barrier strips passes between a respective side of the folded web and a respective sealing bar In the gaps between the opposing sealing bars, the web and string zipper are sandwiched between and held together by the Teflon barrier strips, which move with the web and zipper and prevent the bag making film from sticking against the stationary heated sealing bars during conduction heat sealing. The Teflon barrier strips and intervening web and zipper pass through the nips of a series of guide rollers (not shown). The apparatus that seals zipper 70 to the opposing sides of the web may have the same construction.

Figure 7:
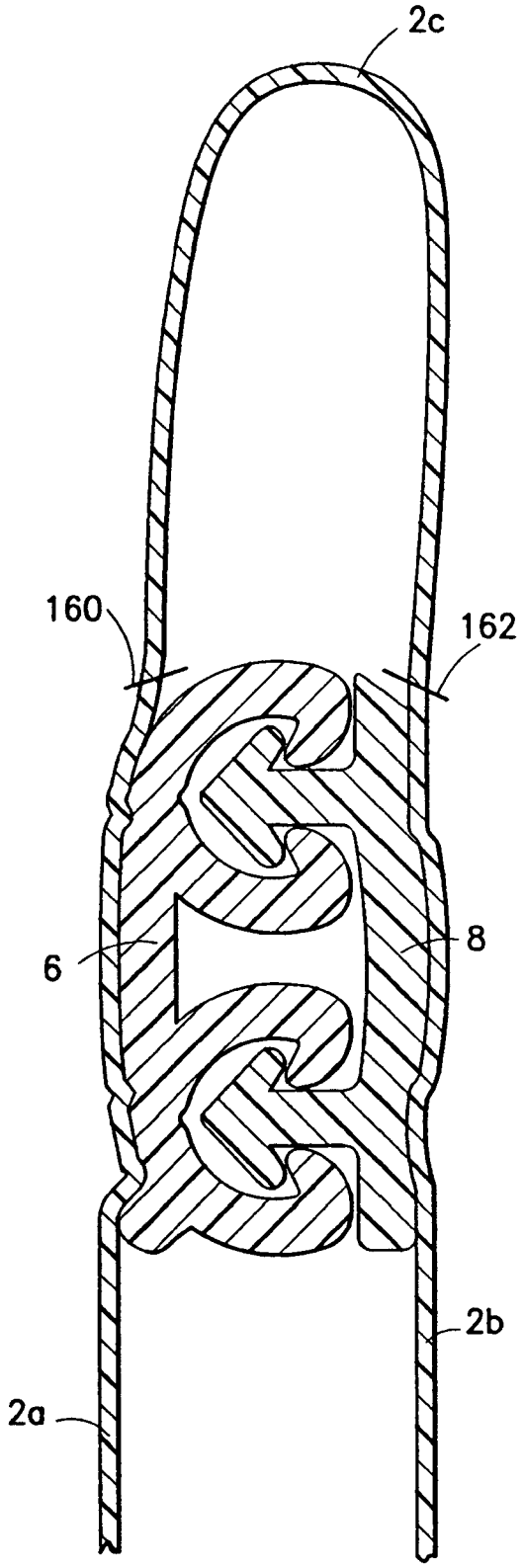
FIG. 7 is a drawing showing a sectional view of the folded edge of the web of film with a string zipper installed in the fold and prior to trimming.

Immediately downstream from the zipper sealing stations, the folded edge of the web 60 above the zipper 72 is cut by a pair of stationary knives 78 (only one of which is visible in FIG. 5). More specifically, each knife cuts a substantial portion of the film that extends beyond the zone of film-to-zipper strip joinder to the fold 76, thereby removing the folded edge of the web. The untrimmed folded edge 2*c* is depicted in FIG. 7, with the cutting lines being indicated by numerals 160 and 162. The cutting lines 160 and 162 should be placed close enough to the respective zipper strips 6 and 8 so that the remnants of film projecting above the zipper are not long enough to interfere with operation of the slider as it moves along the zipper.

Again referring to FIG. 5, a line of spaced perforations 114 is formed in the flap 112 by a perforator 164. Other means for forming a line of weakness could also be used. The perforator 164 may be a reciprocating device mounted at a fixed station. As the zipper-film assembly advances in the machine direction, the reciprocating device will form spaced perforations in the moving flap along a line slightly below the edge of the short side of the folded web.

The trimmed and perforated zipper-film assembly then wends its way through a conventional dancer assembly (not shown in either FIG. 5 or FIG. 6) on its way to the machinery depicted in FIG. 6. The dancer assembly converts the upstream continuous advancement of the film into downstream intermittent advancement of the film. In the intermittent advancement phase, the zipper-film assembly is moved one package increment and then stopped for a period of time, i.e., the dwell time. This cycle is repeated.

Referring to FIG. 6, at the first station after the dancer assembly, the slider 10 is inserted onto the zipper-film assembly. The slider insertion station comprises three assemblies (namely, a separator assembly, a pusher assembly and a clamping assembly) that cooperate to insert the slider on the zipper while the zipper is being held open on both sides of the slider insertion zone.

Upstream of the slider insertion zone, a separator assembly 80 disengages the strips of string zipper 72 while the zipper-film assembly is advanced one package length. The separator assembly 80 comprises a central splitter plate separated by gaps from upper and lower guides disposed above and below the splitter plate. Only the upper guide 82 of the separator assembly is visible in FIG. 6. The upper and lower guides hold the respective strips of zipper 72 in respective grooves formed in the splitter plate (not shown). Thus, as the zipper-film assembly is pulled through the bag making machine (by conventional means not shown), the splitter plate will pry open successive package-length sections of zipper during successive zipper-film advancements.

In the slider insertion zone, a pusher assembly 81 comprises a pusher 88 that pushes a slider 10 onto the zipper 72. The pusher 88 is extended by actuation of an air cylinder 90. When the pusher 88 is retracted, the next slider must be automatically fed to a pre-insertion position directly in front of the pusher. This is accomplished by a conventional pneumatic slider feeding system (not shown).

The upper and lower guides of the separator assembly 80 further comprise respective blades that extend in cantilevered fashion into the slider insertion zone, as taught in U.S. patent application Ser. No. 10/436,433 entitled "Method and Apparatus for Inserting Sliders During Automated Manufacture of Reclosable Bags". These blades are disposed to brace the respective zipper strips against deflection as the slider 10 is pushed onto the zipper.

Downstream of the slider insertion zone, the zipper is clamped by a clamping assembly 83 comprising a retractable separator plate 84 that is interposed between the strips of an open section of the zipper 72. The clamping assembly 83 further comprises upper and lower zipper clamps that clamp the zipper strips against the extended separator plate 84. Only the upper zipper clamp 86 is visible in FIG. 6. The separator plate 84 is extended by actuation of an air cylinder 92. Following extension of the separator plate 84, the upper and lower zipper clamps are extended by actuation of respective air cylinders that are not shown in FIG. 6.

Thus, the upper and lower guides of the separator assembly 80, and the upper and lower clamps of the clamping assembly 83 serve to stabilize the zipper during slider insertion. The interposition of the splitter plate (not shown) and the separator plate 84 between the zipper strips upstream and downstream, respectively, of the slider insertion zone means that the zipper is maintained in an open state, with a gap between the zipper strips, in the zone where the slider is inserted. The zipper strips are held in respective positions such that the slider plow 42 (see FIG. 3) enters the gap between the zipper strips and then the slider side walls respectively pass over the zipper strips during slider insertion. The slider is pushed onto the zipper until the retaining ledges on the slider interior latch under the zipper strips to hold the slider securely on the zipper.

During the same dwell time that a slider is being inserted, a slider end stop structure 67 is being formed on the zipper at an ultrasonic stomping station downstream from the slider insertion device. This slider end stop structure 67 will be bisected later during cutting by a hot knife 100 to form two slider end stops 66 (see FIG. 1), i.e., the end stop at the zipper fully closed slider park position for one package and the end stop at the zipper fully open slider park position for the next package. The end stop structure 67 is formed by an ultrasonic stomping assembly 85 comprising a horn 94 and an anvil (not shown in FIG. 9). The horn 94 transmits sufficient ultrasound wave energy into that plastic zipper material that the plastic is fused into a structure (e.g., a vertically extending hump) defined by the surfaces of the horn and anvil. The horn and anvil may be of the reciprocating or rotary variety.

While the slider end stops 67 are being formed on the string zipper 72, the string zipper 70 is being pre-sealed at package length intervals by another ultrasonic stomping assembly comprising a horn 61 and an anvil (not shown in FIG. 6). Preferably, guiding means are provided for maintaining the zipper strips in alignment while presealing occurs, so that the male and female profiles are pressed together and interlocked by the sealing mechanism. The pre-sealed regions 69 are bisected during cutting by the hot knife 100 to form two pre-seals 68 (see FIG. 1). Upstream of the pre-sealing station, the zipper strips of string zipper 70 are separated by a separator plate 59, so that the zipper sections between the pre-sealed zones will be open when the bags come off the machine.

During each dwell time, other ultrasonic apparatus forms a pair of holes 116 in that portion (i.e., flap 112) of the long side of the web that extends beyond the edge of the short side of the web. For example, a pair of ultrasonic horns 62 and 62' are designed to form respective pairs of circular holes 116 in each package length section of the flap 112. The anvils that cooperate with horns 62 and 62' are not shown in FIG. 6. Alternatively, holes or slits could be made using suitably shaped cutters or punches.

After each dwell time, the zipper-film assembly is advanced. During each intermittent advancement, a slider stopper assembly 87 restrains a slider 10 so that a respective section of zipper is closed. The slider stopper assembly 87 comprises a stopper element 96 coupled to an air cylinder 98. The stopper element 96 is movable from a retracted position to an extended position by actuation of the air cylinder 98. The stopper element 96 is in its extended position when the advancement of the zipper-film assembly begins. In this extended position, the stopper element 96 interferes with the slider and blocks it from advancing with the zipper. This causes a displacement of the slider relative to the zipper in a zipper closing direction, thereby closing a section of zipper. Before the advancement of one package length is completed, the stopper element 96 is retracted, which allows the slider to advance past the retracted stopper element.

In addition, during each dwell time, a hot cutting knife 100 (which may comprise a solitary blade or a pair of opposed blades) cuts and forms side seals in the film on both sides of the cut, thereby severing a bag (not shown in FIG. 8) from the remainder of the web 60 on the bag making machine. Each bag is then placed so that the holes 116 in the wicket flap 112 align with and are penetrated by a pair of posts. Each successive bag takes its place atop the stack of bags mounted to the posts until a predetermined maximum number of bags is achieved. Then the stack is removed from the posts and a wicket is inserted into the aligned holes, these steps being typically performed either manually or automatically.

A stack of wicketed slider bags can be used to package produce, deli meats, or other products. Because the bottom of the bag is open, the packer can simply lift the top layer of the bag bottom, insert the product and then close the bottom of the bag by pressing the zipper strips of the string zipper 70 closed.

In accordance with an alternative embodiment of the automated production line disclosed above, the web of film material and the string zippers could be moved intermittently through the section depicted in FIG. 5. In this case respective lengths of the string zippers would be sealed to the film (e.g., by reciprocating sealing bars) during each dwell time, with the string zippers and film being advanced an equal length during each interval between successive dwell times. The cutting and perforating operations would be performed during advancement of the film.

A reclosable bag having the structure depicted in FIG. 1 can be manufactured using methods other than those described with reference to FIGS. 5 and 6. For example, instead of folding the web of film and then inserting and joining string zipper material between opposing web portions, one side of each string zipper material could be joined to the film, the film is then folded, and thereafter the other side of each string zipper is joined to a confronting portion of the folded web. Alternatively, respective flangeless zipper strips could be joined in parallel to an unfolded web, the web is then folded along a centerline, and the zipper strips are interlocked after folding.

Instead of starting with a single web that is folded, one could begin with two webs that will be sealed on two sides with respective string zippers being attached at opposing ends of each receptacle. The use of two webs would again entail the three variations, for each string zipper, of: (1) placing the string zipper between the webs and sealing the sides of the zipper to the respective webs; (2) sealing one side of the string zipper to one web, placing the other web in opposing relationship, and then sealing the other side of the string zipper to the other web; and (3) sealing one flangeless zipper strip to one web, sealing the other flangeless zipper strip to the other web, and then interlocking the zipper strips while attached to the respective webs.

The invention does not require that the slider have a plow or separating finger. The slider-zipper assembly could be designed so that the side walls of a straddling slider cam or push the zipper open, without the aid of a plow or separating finger, when the slider is moved in an opening direction.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

The invention claimed is:

1. A reclosable bag comprising:

a receptacle comprising first and second walls joined at their sides, said first and second walls comprising respective upper marginal portions that form a mouth at a top of said receptacle and respective lower portions at a bottom of said receptacle, said upper marginal portions of said first and second walls being bounded at the top by respective top edges of said first and second walls;

a first string zipper comprising a first pair of mutually interlockable flangeless zipper parts having backs respectively joined to said upper marginal portions of said first and second walls adjacent or near to said top edges of said first and second walls;

a second string zipper comprising a second pair of mutually interlockable flangeless zipper parts having backs respectively joined to said lower portions of said first and second walls;

a slider mounted on said first string zipper for opening and closing said first string zipper, said slider comprising first and second side walls that are spaced apart to define a passageway therebetween for passage therethrough of said first string zipper, wherein a portion of said top edge of said first wall and a portion of said top edge of said second wall are disposed between said first and second side walls of said slider; and a flap extending downward from said bottom of said receptacle.

2. The bag as recited in claim 1, wherein said flap is integrally formed with said first wall.

3. The bag as recited in claim 1, wherein said flap comprises first and second holes.

4. The bag as recited in claim 1, wherein said flap comprises, a line of weakened tear resistance.

5. The bag as recited in claim 4, wherein said line of weakened tear resistance comprises a series of spaced perforations.

6. The bag as recited in claim 4, wherein said line of weakened tear resistance comprises a scoreline.

7. The bag as recited in claim 4, wherein said line of weakened tear resistance extends across substantially the entire length of said flap.

8. The bag as recited in claim 1, wherein said slider further comprises a plow that partitions said passageway into first and second spaces respectively occupied by portions of said respective flangeless zipper parts of said first string zipper, said upper marginal portions of said first and second walls passing through said first and second spaces respectively.

9. The bag as recited in claim 8, wherein said slider further comprises a first retaining ledge projecting from said first side wall into said passageway, and a second retaining ledge projecting from said second side wall into said passageway, said first retaining ledge being latched under a portion of said one zipper part of said first string zipper, and said second retaining ledge being latched under a portion of said other zipper part of said first string zipper.

10. The bag as recited in claim 1, wherein said one zipper part of said first string zipper comprises first and second male profiles, and said other zipper part of said first string zipper comprises first and second female profiles that respectively receive said male profiles when said first string zipper is closed.

11. The bag as recited in claim 10, wherein one of said zipper parts of said second string zipper comprises third and fourth male profiles, and the other zipper part of said second string zipper comprises third and fourth female profiles in which said third and fourth male profiles are respectively received.

12. A reclosable bag comprising:

a receptacle having a top and a bottom, said top comprising first and second top edges along a mouth of said receptacle;

a first string zipper attached to said top of said receptacle for providing access to an interior volume of said receptacle, said first string zipper comprising first and second flangeless zipper parts that are mutually interlockable and have respective backs joined to said top of said receptacle;

a second string zipper attached to said bottom of said receptacle, said second string zipper comprising third and fourth flangeless zipper parts that are mutually interlockable and have respective backs joined to said bottom of said receptacle;

a slider mounted on said first string zipper for opening and closing said first string zipper, said slider comprising first and second sidewalls;

a flap extending downward from said bottom of said receptacle, said flap comprising a discontinuity and a line of weakened tear resistance that traverses an area disposed between said second string zipper and said discontinuity, wherein said second string zipper has no slider mounted thereon and respective portions of said first and second top edges of said receptacle are disposed between said first and second sidewalls of slider.

13. The bag as recited in claim 12, wherein said flap further comprises a second discontinuity spaced apart from said discontinuity on the same side of said line of weakened tear resistance.

14. The bag as recited in claim 12, wherein said receptacle comprises first and second walls, and said flap is integrally formed with said first wall.

15. The bag as recited in claim 12, wherein said discontinuity comprises a hole.

16. The bag as recited in claim 12, wherein said line of weakened tear resistance comprises a series of spaced perforations.

17. The bag as recited in claim 12, wherein said line of weakened tear resistance comprises a scoreline.

18. The bag as recited in claim 12, wherein said flap is the only portion of said bag that extends downward beyond said second string zipper.

* * * * *